US007566039B2

(12) United States Patent
Hung

(10) Patent No.: US 7,566,039 B2
(45) Date of Patent: Jul. 28, 2009

(54) MOVABLE SUPPORT TRAY APPARATUS FOR A COMPUTER KEYBOARD

(76) Inventor: Wen-Min Hung, 7F-3, No. 16, Lane 147, Datong Rd., Sanxia Town, Taipei County 237 (TW)

( * ) Notice: Subject to any disclaimer, the term of this patent is extended or adjusted under 35 U.S.C. 154(b) by 0 days.

(21) Appl. No.: 11/945,730

(22) Filed: Nov. 27, 2007

(65) Prior Publication Data

US 2009/0084917 A1 Apr. 2, 2009

(30) Foreign Application Priority Data

Sep. 28, 2007 (TW) ..... 96216201 U

(51) Int. Cl.
*E04G 3/00* (2006.01)

(52) U.S. Cl. ..... 248/278.1; 248/371; 248/280.11; 248/281.11; 248/292.13; 248/918; 108/6

(58) Field of Classification Search ..... 248/278.1, 248/371, 372.1, 397, 279.1, 280.11, 281.11, 248/292.12, 292.13, 292.14, 918, 585; 108/6, 108/1, 138, 140
See application file for complete search history.

(56) References Cited

U.S. PATENT DOCUMENTS 4,616,798 A * 10/1986 Smeenge et al. ..... 248/281.11
4,706,919 A * 11/1987 Soberalski et al. ..... 248/281.11
6,273,382 B1 * 8/2001 Pemberton ..... 248/286.1
6,488,248 B1 * 12/2002 Watt et al. ..... 248/279.1

* cited by examiner

*Primary Examiner*—Anita M King

(57) ABSTRACT

A movable support tray apparatus for a computer keyboard includes a sliding member, a lift member, a tray member and an inclining member. The sliding member provides a fixing plate for being attached to the bottom of a table top and a sliding seat for being pivotally connected to a respective end of two lateral sides of an upper and lower connecting box sections provided with the lift member. Another end of said upper connecting box section is pivotally connected to a tray plate of the tray member and a lock part and a pair of retarding wheels provided with the lift member. The inclining member is disposed on the lock part and provides a stem handle. The sliding seat is capable of sliding in the fixing plate to move the upper and lower connecting box sections forward and backward. The upper and lower connecting box sections are capable rotating with respect to the sliding seat to perform upward and downward movements with the return spring. The stem handle of the inclining member is capable of rotating the eccentric collars. Hence, the tray plate with the keyboard thereon can move upward, downward, forward, backward and angularly.

10 Claims, 5 Drawing Sheets

MOVABLE SUPPORT TRAY APPARATUS FOR A COMPUTER KEYBOARD

BACKGROUND OF THE INVENTION

1. Field of the Invention

The present invention relates to a movable support tray apparatus for a computer keyboard, and, more particularly, to a support tray apparatus, which is available for placing a keyboard and is capable of being operated to move forward, backward, upward, downward and angularly.

2. Description of Related Art

The conventional support device for a computer keyboard is usually mounted under the tabletop. The conventional support device comprises two opposite rails and a tray slidably mounted between the two rails such that the tray can be moved forward when the computer keyboard is ready for use and moved backward while the computer keyboard is not in use.

However, the tray can be horizontally moved only and the elevation of the tray is not adjustable for being suitable for different statures of the users. In addition, the tray is not possible for being adjusted to turn an inclining angle. As a result, the keyboard placed on the tray is restricted to move horizontally along with the tray. Hence, the conventional keyboard support device is incapable of being operated by different users conveniently and comfortably.

SUMMARY OF THE INVENTION

The main object of the present invention is to provide a movable support tray apparatus for a computer keyboard with which adjustments of the tray plate such as moving forward, backward, upward, downward, and turning an inclining angle can be performed to meet different needs of the users.

To achieve the object, a movable support tray apparatus for a computer keyboard in accordance with the present invention comprises a sliding member, a lift member, a tray member and an inclining member. The sliding member provides a fixing plate for being attached to the bottom of a tabletop and a sliding seat for being pivotally connected to a respective end of two lateral sides of both the upper and lower connecting box sections provided with the lift member. Another end of the upper connecting box section is pivotally connected to the tray member and a lock part and a pair of retarding wheels is provided at the lift member. The inclining member is disposed on the lock part and provides a stem handle. The sliding seat is capable of sliding in the fixing plate to move the tray member forward and backward. The upper and lower connecting box sections can rotate with respect to the sliding seat pivotally and the return spring can keep the upper and lower connecting box sections at an desirable elevation. The stem handle of the inclining member is capable of rotating the eccentric collars and the locating springs to perform angular adjustment. Therefore, the keyboard on the tray member can move upward, downward, forward, backward and angularly while the movable support tray apparatus of the invention is operated.

BRIEF DESCRIPTION OF THE DRAWINGS

Further benefits and advantages of the present invention will become apparent after a careful reading of the detailed description with appropriate reference to the accompanying drawings, in which.

DETAILED DESCRIPTION OF THE INVENTION

Figure 1:
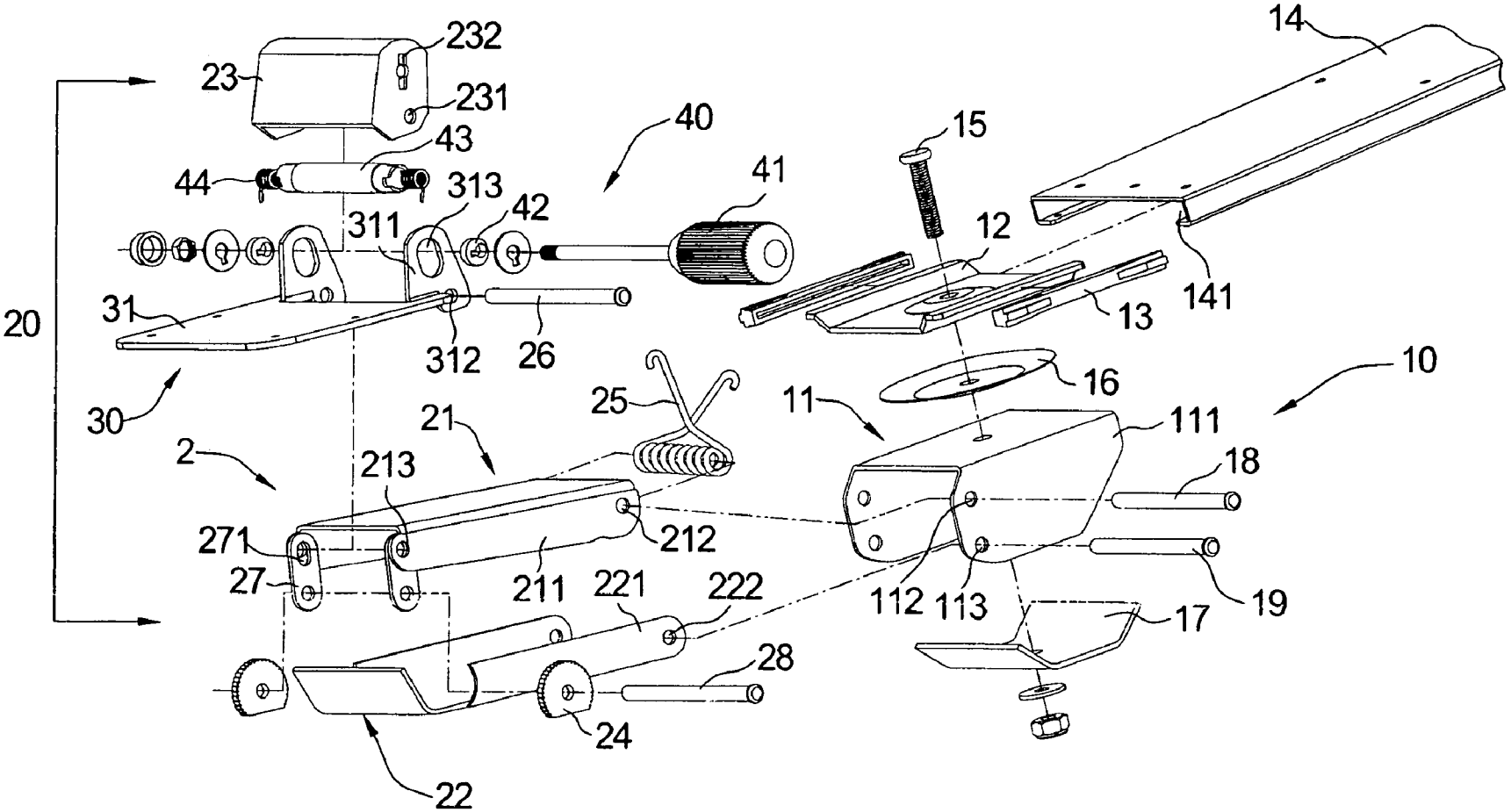
FIG. 1 is an exploded perspective view of a movable support tray apparatus for a computer keyboard in accordance with the present invention.
Figure 2:
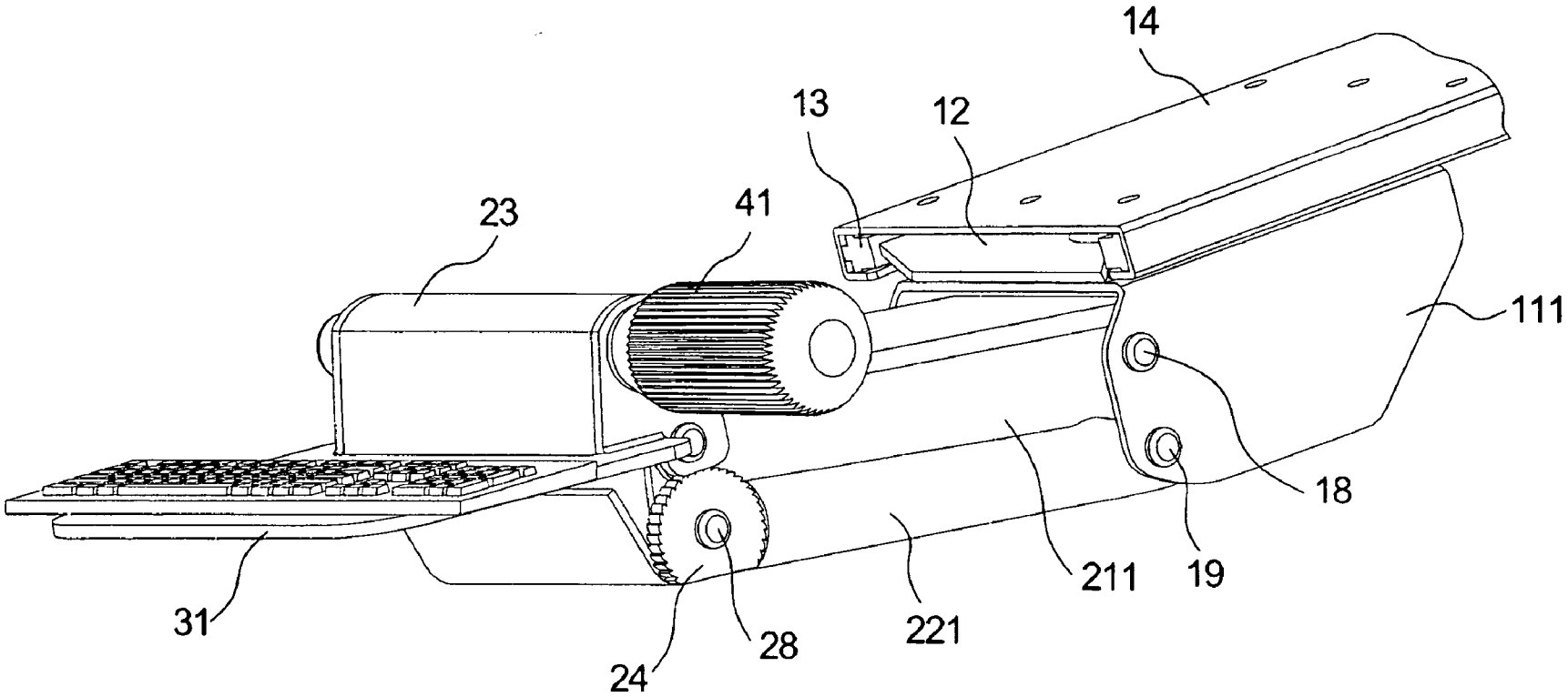
FIG. 2 is a perspective view of the movable support tray apparatus for a computer keyboard shown in FIG. 1.
Figure 3:
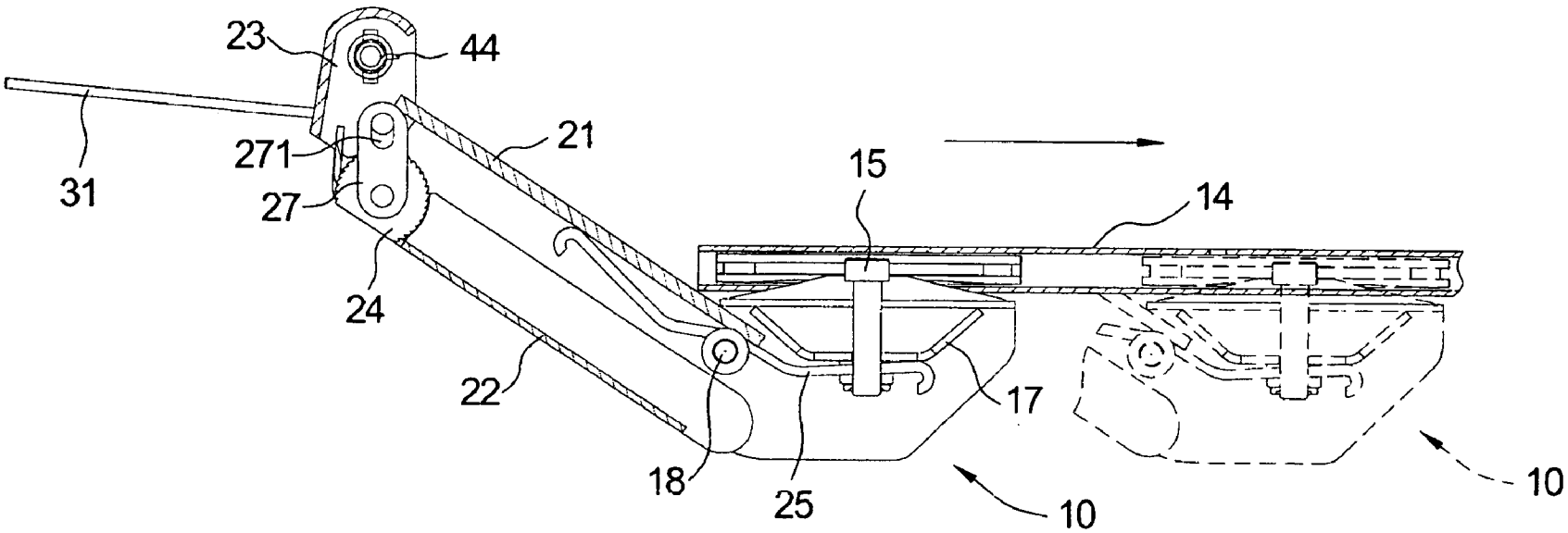
FIG. 3 is a sectional view illustrating operation of a sliding assembly of the movable support tray apparatus shown in FIG. 1.

Referring to FIGS. 1 to 3, a movable support tray apparatus for a computer keyboard in accordance with the present invention comprises a sliding member 10, a lift member 20, a tray member 30 and an inclining member 40. The lift member 20 is pivotally attached to the sliding member 10 and the tray member 30 is pivotally joined to the lift member 20. The inclining member 40 is secured to the lift member 20.

The sliding member 10 further includes a U-shaped sliding seat 11, a sliding plate 12, a plurality of sliding rails 13 and a fixing plate 14. The sliding seat 11 provides an upper pivotal hole 112 and a lower pivotal hole 113 at a lateral side of two opposite side sections 111 thereof respectively such that the two upper pivotal holes 112 align with each other and the two lower pivotal holes 113 align with each other. The sliding plate 12 is disposed on the sliding seat 11 and attached to the sliding seat 11 with a fastener 15 such as a bolt and a circular rubber pad 16 can be interposed between the sliding seat 11 and the sliding plate 12. A reinforcing plate 17 can be provided in the sliding seat 11. The sliding rails 13 are attached to two lateral sides of the sliding plates 12 and the fixing plate 14 has a U-shaped sliding groove 141 at two elongated opposite lateral sides thereof for slidably receiving the sliding rails 13.

The lift member 20 further includes an upper connecting box section 21, a lower connecting box section 22, a U-shaped locking part 23 and two retarding wheels 24. The upper connecting box section 21 has an inverted U-shape with two opposite elongated side plates 211 providing a pivotal hole 212, 213 at two ends thereof respectively such that the pivotal hole 212 at the two opposite elongated side plates 211 aligns with each other. The pivotal hole 213 at the two opposite elongated side plates 211 aligns with each other. A return spring 25 is disposed in the upper box section corresponding to the pivotal holes 212 with two ends thereof pressing against the two opposite elongated side plates 211. A pivotal rod 18 passes through the respective upper pivotal hole 112 of the sliding seat 11, the pivotal holes 212 of the upper box section 21 and the return spring 25 respectively such that the sliding seat 11 is capable of joining to the upper connecting box section 21 pivotally. The lower connecting box section 22 provides a U-shape with two opposite elongated side plates 221 having a pivotal hole 222 at an end thereof corresponding to the respective lower pivotal hole 113 of the sliding seat 11 such that another pivotal rod 19 passes through the respective lower pivotal hole 113 and the respective pivotal hole 222 of the lower connecting box 22 to join the sliding seat 11 to the lower connecting box section 22. Further, each side plate 212 of the upper connecting box section 21 is attached to a connecting tab 27 at the inner side thereof corresponding to the pivotal hole 213 respectively. The respective connecting tab 27 has an elongated hole 271 at an end thereof to align with the pivotal hole 213 and has a pivotal hole at another end thereof. The lock part 23 basically provides an inverted L shaped cross section with two opposite closed lateral sides and each of the closed lateral sides has a pivotal hole 23 1 and an elongated hole 232 respectively. A first pivotal shaft 26 passes through the pivotal hole 213 of the upper connecting box section 21, the pivotal hole 231 of the locking part 23 and the elongated hole 271 of the respective connecting tab 27 such that the locking part 23, the upper connecting box section 21 and the connecting tab 27 can be pivotally connected to one another. The retarding wheels 24 are disposed at the side plates 221 of the lower connecting box section 22 opposite to the pivotal hole 212 respectively and the respective retarding wheel 24 has a flat cut-out side, which is disposed at the bottom of the lower connecting box section 22 and is flush with the side plates 221 of the lower connecting box section 21. A second pivotal shaft 28 passes through the retarding wheels 24 and the pivotal hole of the respective connecting tab 27 for the respective retarding wheel 24 being able to pivotally locate at the lower connecting box section 22.

The tray member 30 further includes a tray plate 31 and two opposite pivotal ears 311. The two pivotal ears 311 are attached to two corners of the tray plate 31 next to the lock part 23. The pivotal ears 311 are disposed upright in parallel with each other. Each of the pivotal ears 311 provides a pivotal hole 312 and an elongated hole 313 to corresponding to the pivotal holes 231 and the elongated holes 232 at two lateral sides of the lock part 23 respectively. The first pivotal shaft 26 passes through the pivotal hole 312 too such that the respective pivotal ear 311 is able to connect with the lock part 23 and the respective connecting tab 27.

The inclining member 40 further comprises a handle stem 41, two eccentric collars 42 and a spring retaining sleeve 43. The eccentric collars 42 fit with the elongated hole 313 of the respective connecting ear 311. The spring retaining sleeve 43 is disposed between the connecting ears 311 with two ends thereof providing a locating spring 44 respectively. The handle stem 41 passes through the elongated hole 232 at the respective lateral side of the locking part 23, the eccentric collars 42 and the spring retaining sleeve 43.

Figure 4:
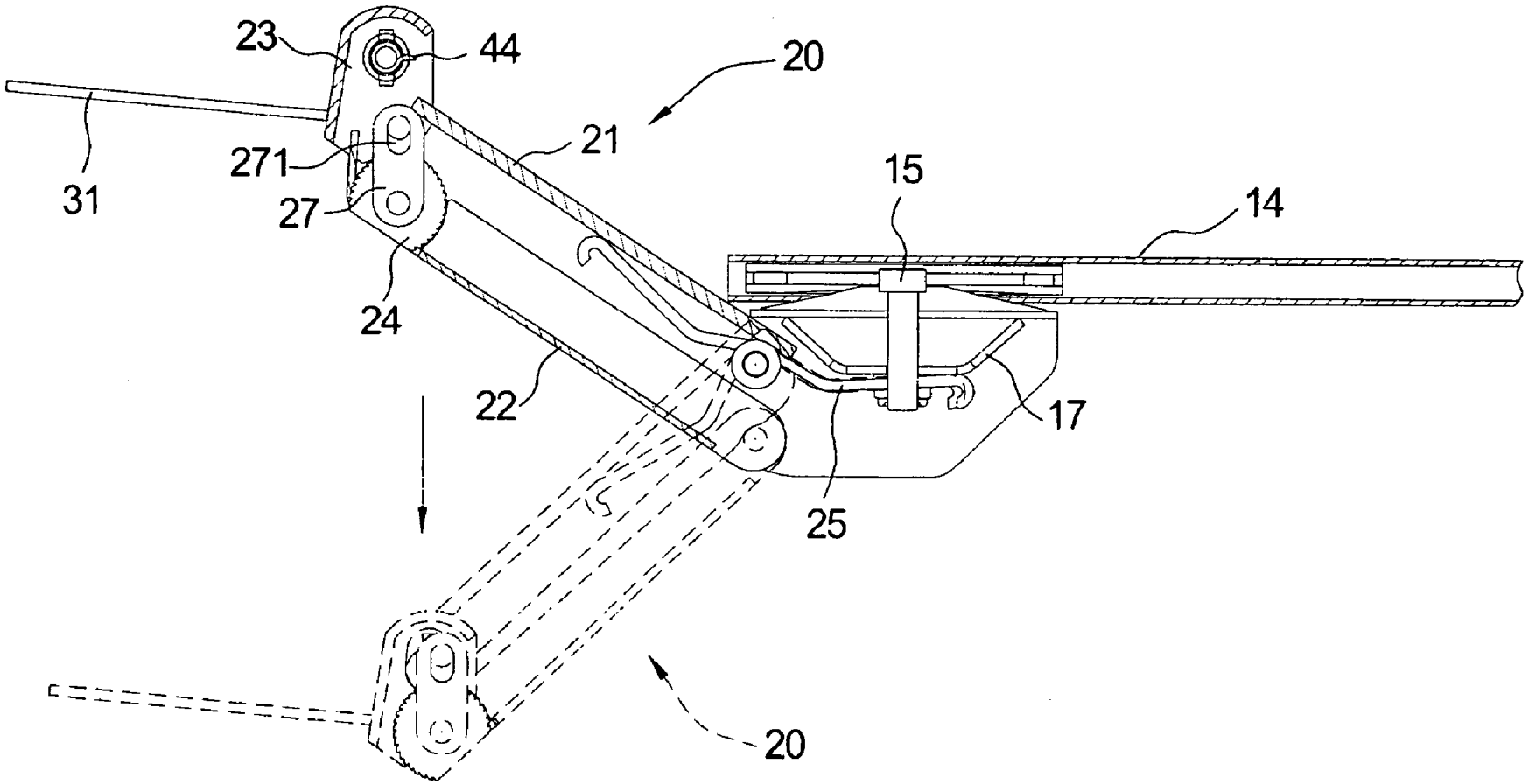
FIG. 4 is a sectional view illustrating operation a lift member of the movable support tray apparatus shown in FIG. 1.
Figure 5:
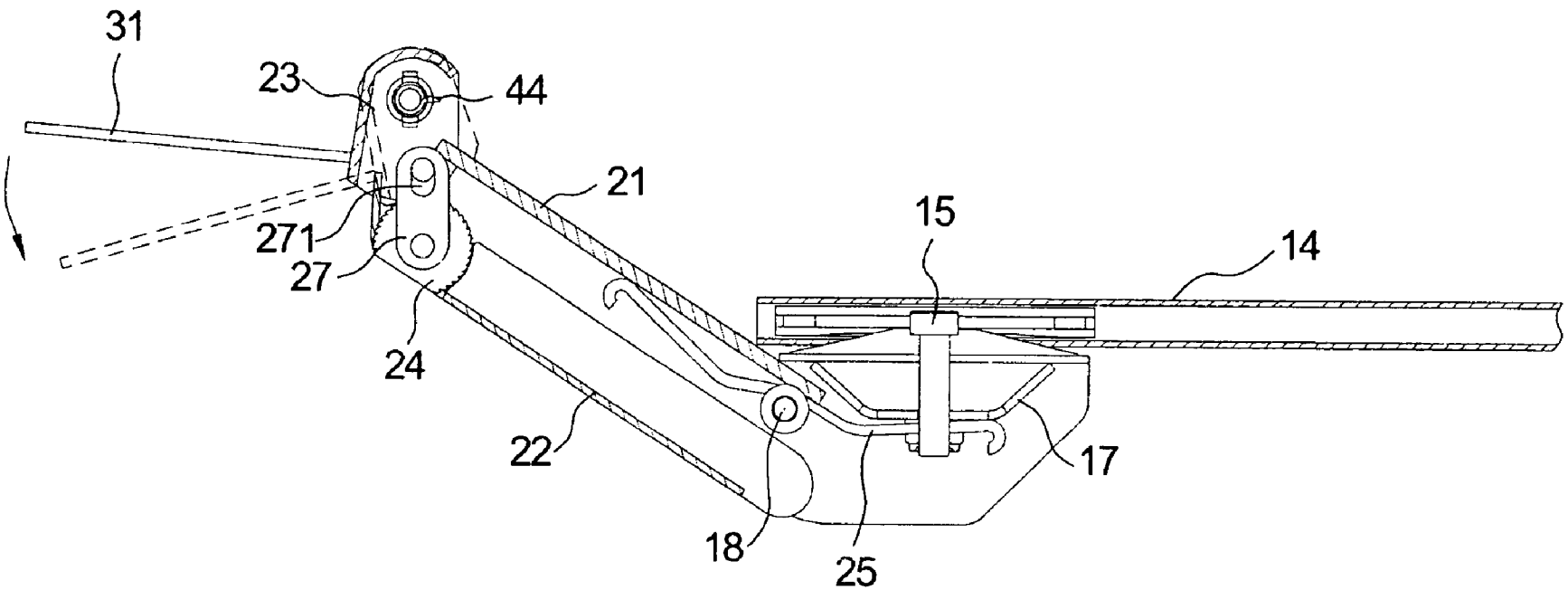
FIG. 5 is a sectional view illustrating a tray member of the movable support tray apparatus shown in FIG. 1.

It can be seen in FIG. 3 that when the movable support tray apparatus for a computer keyboard in accordance with the present invention is in operation, the sliding seat 11 of the sliding member 10 can move forward and backward on the fixing plate 14 and the lift member 20 can move forward and backward along with the sliding seat 11. Further, the tray plate 31, which is pivotally connected to the lift member 20, can move forward and backward as well. It can be seen in FIG. 4 that the upper connecting box section 21 and the lower connecting box section 22 pivotally rotate with respect to the sliding seat 11 at the time of being lifted upward or pressed downward. Due to the lateral sides of the locking part 23 contacting with the outer teeth of the respective retarding wheel 24, which is disposed at the lower connecting box section 22, the upper connecting box section 21 and the lower connecting box section 22 can be kept at a specific position with elastic force of the return spring 25 while the retarding wheels 24 and the locking part 23 moving to a locating position such that the lift member 20 and the tray plate 31 can displace upward and downward. It can be seen in FIG. 5 that when the stem handle 41 is turned to rotate the respective eccentric collar 42, actuation of the eccentric collar 42 in the elongated hole of the respective connecting ear 311 allows the tray plate 31 to rotate an inclining angle with respect to the first pivotal shaft 26.

Although the invention has been explained in relation to the preferred embodiment thereof, it is to be understood that many other possible modifications and variations can be made without departing from the spirit and scope of the invention as hereinafter claimed.

What is claimed is:

1. A movable support tray apparatus for a computer keyboard comprising:

a sliding member, which further comprises a sliding seat, a sliding plate and a fixing plate, wherein said sliding plate is inserted with a sliding rail at two lateral sides thereof respectively and being movably received in said fixing plate and said sliding seat is attached to the bottom of said sliding plate;

a lift member, which further comprises a upper connecting box section, a lower connecting box section, a pair of retarding wheels and a lock part, wherein an end of said upper connecting box section and an end of said lower connecting box section are pivotally connected to an end of two lateral sides of said sliding seat respectively and another end of said upper connecting box section is pivotally connected to said lock part and said retarding wheels; and a tray member providing a tray plate, which is pivotally connected to said another end of said upper connecting box section with said lock part;

wherein, said sliding seat is capable of sliding in said fixing plate to move said upper and lower connecting box sections upward and downward such that said upper and lower connecting box sections are capable of rotating with respect to said sliding seat pivotally and said tray plate is capable of moving upward and downward.

2. The movable support tray apparatus for a computer keyboard as defined in claim 1, wherein a rubber pad is sandwiched between said sliding seat and sliding plate.

3. The movable support tray apparatus for a computer keyboard as defined in claim 1, wherein said sliding seat further provides a reinforcing plate.

4. The movable support tray apparatus for a computer keyboard as defined in claim 1, wherein said upper connecting box section provides two opposite lateral sides and an end of each of said lateral sides pivotally connects with said sliding seat with a first pivotal shaft and a return spring is disposed between side two lateral sides for said pivotal shaft passing through.

5. The movable support tray apparatus for a computer keyboard as defined in claim 4, wherein said retarding wheels are pivotally connected to a connecting tab respectively with a second pivotal shaft and are disposed at said lower connecting box section such that said connecting tab and said lock part are capable of pivotally connecting with said upper connecting box section with said first pivotal shaft.

6. The movable support tray apparatus for a computer keyboard as defined in claim 5, wherein said connecting tab has an elongated hole for being passed through with said first pivotal shaft.

7. The movable support tray apparatus for a computer keyboard as defined in claim 5, wherein said tray plate provides a connecting ear at two opposite corners thereof respectively with a further elongated hole at said connecting ear for pivotally connecting with an inclining member.

8. The movable support tray apparatus for a computer keyboard as defined in claim 7, wherein said elongated hole fits with an eccentric collar respectively and a spring fixing sleeve with two ends of said spring sleeve fitting with a locating spring respectively.

9. The movable support tray apparatus for a computer keyboard as defined in claim 1, wherein said tray plate provides a connecting ear at two opposite corners thereof respectively with a further elongated hole at said connecting ear for pivotally connecting with an inclining member.

10. The movable support tray apparatus for a computer keyboard as defined in claim 9, wherein said elongated hole fits with an eccentric collar respectively and a spring fixing sleeve with two ends of said spring sleeve fitting with a locating spring respectively.

* * * * *